US005755241A

United States Patent [19]

Cheung

[11] Patent Number: 5,755,241

[45] Date of Patent: May 26, 1998

[54] APPLICATOR FOR APPLYING FLUID

[76] Inventor: Yuen Pong Cheung, 42 Blackfriars Court, Newcastle Upon Tyne, NE1 4XB, England

[21] Appl. No.: 776,748

[22] PCT Filed: Aug. 11, 1995

[86] PCT No.: PCT/GB95/01901

§ 371 Date: Feb. 13, 1997

§ 102(e) Date: Feb. 13, 1997

[87] PCT Pub. No.: WO96/04814

PCT Pub. Date: Feb. 22, 1996

[30] Foreign Application Priority Data

Aug. 13, 1994 [GB] United Kingdom ..... 9416394

[51] Int. Cl.[6] ..... A45D 24/22; A45D 24/26

[52] U.S. Cl. ..... 132/112; 132/116; 401/137; 401/281; 401/284

[58] Field of Search ..... 132/112, 113, 132/114, 116; 401/281, 284, 137

[56] References Cited

U.S. PATENT DOCUMENTS

| | | | |
|---|---|---|---|
| 2,574,130 | 11/1951 | Springborn et al. | 132/112 X |
| 4,273,144 | 6/1981 | Morganroth | 132/270 |
| 4,495,958 | 1/1985 | Roeder | 132/113 |
| 4,516,591 | 5/1985 | Hierholzer | 132/116 X |

FOREIGN PATENT DOCUMENTS

| | | | |
|---|---|---|---|
| 643633 | 9/1950 | United Kingdom | 401/28 |
| 8809632 | 12/1988 | WIPO | 132/112 |

*Primary Examiner*—Steven A. Bratlie
*Attorney, Agent, or Firm*—Larson & Taylor

[57] ABSTRACT

An applicator primarily for applying colorants and other treatments to hair includes a container to which is mounted, preferably releasably, a reservoir for the treatment fluid, the reservoir being provided with at least two, and preferably between six and ten nozzles. The bores of the nozzles communicate with the interior of the reservoir so that fluid can be expelled from the reservoir through the nozzles and onto the hair in a controlled manner. The applicator is particularly convenient for applying several narrow bands of color to the hair.

11 Claims, 2 Drawing Sheets

APPLICATOR FOR APPLYING FLUID

FIELD OF THE INVENTION

The present invention relates to an applicator for applying various fluid products, for example for applying colorants to hair.

BACKGROUND OF THE INVENTION

The application of treatment fluids to hair requires skill and practice if good results are to be achieved. The quality of the result is often dependent upon the skill and precision with which the treatment is applied, and so an applicator which helps a hairdresser to control the application of a fluid is beneficial in achieving a desired result.

It is already known for a hairdresser to place a prepared treatment fluid into a plastic container provided with a nozzle through which the fluid may be squeezed on to the hair. Although this method of application is convenient and less messy than applying the fluid from a bowl using a brush, if a very fine nozzle is used to achieve a precise line of treatment, the rate at which fluid can be expelled from such a nozzle makes the application slow. Also, it can be difficult to ensure that the treatment is applied to the correct parts of the hair.

DE-A-3743713 discloses a hairbrush having a plurality of substantially parallel bristles some of which are hollow whereby a treatment fluid from a container embodied in the brush can be fed into the user's hair.

It would be desirable to be able to provide an alternative form of fluid applicator which overcomes some at least of the problems encountered with current forms of applicator, and in particular which enables accurate control in the application of the fluid to a substrate.

SUMMARY OF THE INVENTION

According to the present invention, there is provided an applicator for applying a fluid to a substrate comprising a reservoir for containing a treatment fluid, at least two nozzles spaced apart from one another and generally parallel with one another, and a passage connecting each of said nozzles to the reservoir, characterised in that the nozzles are each movable between an open position in which a bore therethrough communicates with the interior of the reservoir, and a closed position in which flow of fluid therethrough from the reservoir is prevented.

The provision of at least two spaced apart nozzles allows fluid to be applied to at least two separate areas simultaneously, which has particular advantages when used to apply color in the form of "highlights" or "lowlights" to hair, because several narrow bands of color usually give a more natural-looking result than a single wider band.

Although the invention is described in terms of its suitability for use in applying hair treatments, its advantages may be beneficial in other uses such as in the application of decorative paint effects.

The reservoir may be an integral part of a complete container such as a tube or bottle in which the treatment fluid is contained. The reservoir is, however, preferably readily detachable from such a container so that it may be cleaned easily between applications. Most preferably, it is attached to and detachable from the container, for example by means of a screw-threaded connection or by a ridge provided on one of the reservoir and the container for engagement in a groove provided on the other of the reservoir and the container.

The applicator may be used with a wide variety of containers and fluid expulsion means. For example one type of suitable container has a piston-like plate which may be caused to move towards the nozzles to force the fluid contained in the container out of the nozzles by depressing a plunger to which the plate is attached, as in a syringe, or by activation of a sprung mechanism by depressing a trigger, for example. Alternatively, some form of pressured container may be used from which fluid may be expelled through the nozzles by applying gas pressure within the container.

A preferred type of container is a flexible tube or bottle from which fluid may be expelled by squeezing.

The reservoir is connected to at least two nozzles through which fluid may be expelled from the reservoir. Preferably at least three nozzles are provided, and most preferably six to ten nozzles, spaced apart from each other in a direction transverse to the axes of the nozzle exits.

The nozzles may each be opened and closed independently of one another. The nozzles are preferably pivotal between their open and closed positions ie. of a type which are joined to the reservoir by means of a pivotal connection whereby they may be closed by pivoting or folding them towards the reservoir so that the fluid passage therethrough is interrupted, or opened by being positioned to extend from the reservoir, so that the fluid passage between the reservoir and the nozzle becomes essentially linear and uninterrupted. By these means, the amount of fluid applied and the width of a section of hair to be treated may be controlled by opening the required number of nozzles. Also, the fluid may be applied in a number of narrow stripes which may be required specifically when carrying out certain types of treatment, for example putting highlights in hair.

Preferably the applicator further comprises a generally elongate spreader located transversely to the axes of the nozzles and in close proximity to said nozzles. The presence of a spreader allows the person applying the fluid greater control over application of the fluid, because the spreader may be braced against is the part of the substrate which is being treated.

The elongate spreader may be a solid bar, optionally tapered away from the reservoir.

Preferably, however, the spreader comprises a comb which has relatively fine teeth. In this form, the comb and nozzles are preferably arranged so that the nozzles each discharge fluid between two adjacent teeth of the comb. Alternatively, the spreader may comprise a brush, in which form it may be particularly suitable for applying paint, especially for producing decorative effects.

The spreader is preferably joined to an external wall of the reservoir in such a way that it is inclined towards the axes of the open nozzles preferably at an angle of between 30° and 60° to the axes of the nozzles. The spreader may touch the ends of the nozzles. The spreader may, optionally, be adapted to be readily detachable from and attachable to the reservoir, so that it can be removed for cleaning or for storage, for example. It may, for example, have a tongue running along an edge which may frictionally engage in a corresponding slot in the reservoir.

The applicator is preferably made from a suitable plastics material, such as polypropylene. The reservoir, nozzles and spreader, if present, are preferably relatively rigid. The container, reservoir and nozzles are preferably transparent or translucent, so that the amount and composition of the fluid contained therein may be viewed from the outside. The reservoir and/or a container to which it is secured may be marked to indicate the volume of fluid contained therein. Preferably the markings are graduated along a substantial part of the container or reservoir and, most preferably, they are marked in such a way that they may indicate the volume of fluid in the container and/or reservoir both when the applicator is uppermost and when it is pointing downwards, which would normally be its position when in use.

The container may optionally contain a heavy bar, bead or the like to agitate the treatment fluid on shaking of the container.

BRIEF DESCRIPTION OF THE DRAWINGS

One preferred form of the invention will now be described, by way of example only, and with reference to the accompanying drawings of which.

DETAILED DESCRIPTION OF THE PREFERRED EMBODIMENTS OF THE INVENTION

Figure 1:
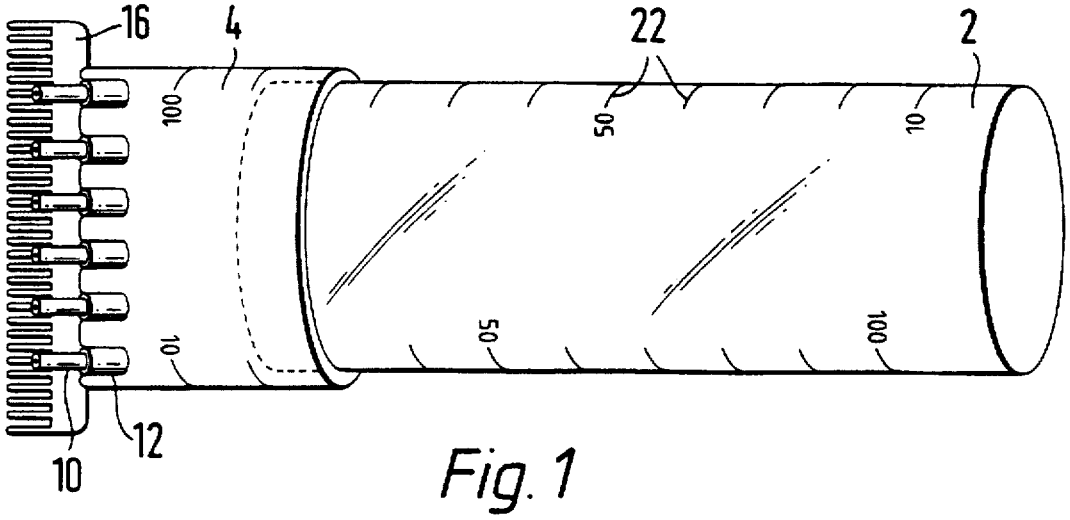
FIG. 1 is a plan view of a hair treatment applicator according to the invention.
Figure 2:
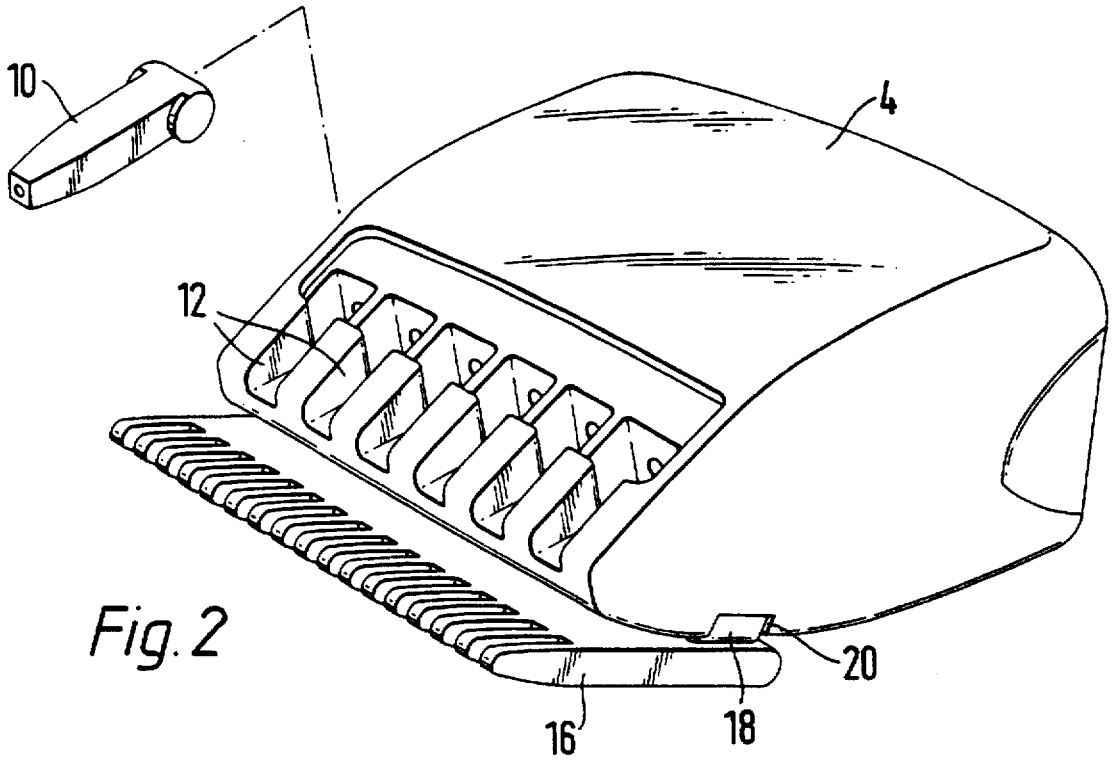
FIG. 2 shows a reservoir of an applicator according to the invention with the nozzles removed and a spreader attached.

The hair treatment applicator shown in FIG. 1 comprises a container 2 formed of a flexible transparent plastics material, and a reservoir 4, also transparent but more rigid than the container 2. The reservoir 4 is secured to the container 2 by means of a ridge 6 around the circumference of the container 2 the underside of which is engaged by projections 8 formed on the opposed inner walls of the reservoir. The components 2 and 4 may be pushed together into positive engagement and subsequently separated by pulling them apart so as to disengage the projections 8 from the ridge 6.

Alternatively the reservoir 4 may be secured to the container 2 by means of an external screw-thread provided on the container 2 co-operating with a corresponding internal screw-thread provided in the reservoir 4.

The reservoir 4 is provided with six nozzles 10 each pivotal within an associated groove 12 in the reservoir 4 between an open position, in which the nozzle extends longitudinally of the applicator and the bore 14 therethrough communicates with the interior of the reservoir 4, and a closed position in which the nozzle 10 extends outwardly of the reservoir 4 and the bore 14 is disconnected from the interior of the reservoir 4.

Figure 3:
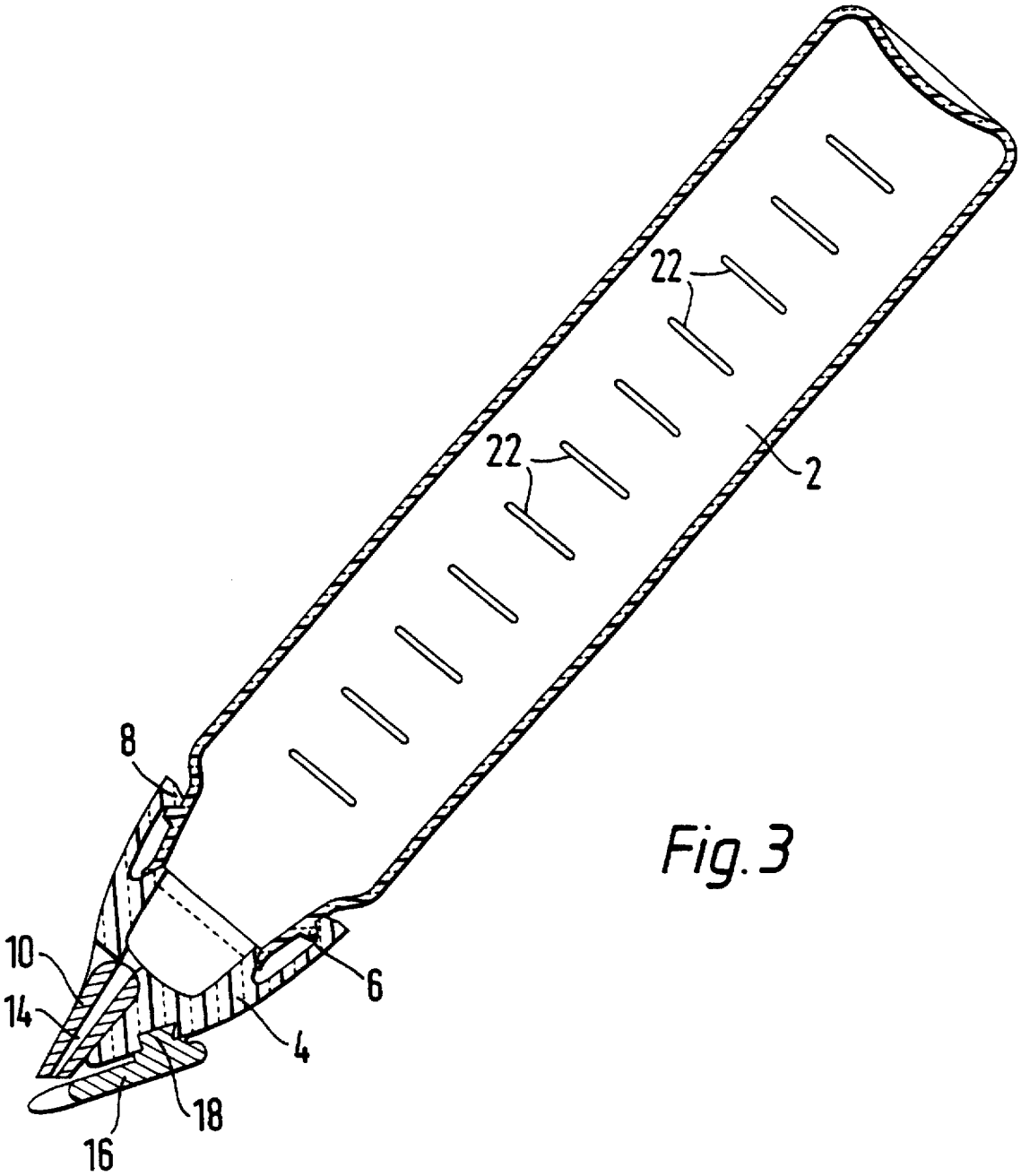
FIG. 3 is a longitudinal section through an applicator according to the invention in its operative position.

A comb or spreader 16 is releasably mounted to the reservoir 4, for example by means of a tongue 18 on the comb 16 being slidably received in a corresponding groove 20 in the reservoir 4, the plane of the comb 16 making an angle of about 40° to the axes of the container 2 as best seen in FIG. 3.

Alternatively, the comb 16 may be mounted to the reservoir 4 by means of a projection provided on the comb 16 which is a friction push-fit into a corresponding recess in the reservoir 4.

In use, a quantity of hair treatment fluid, such as a colorant, is placed into the container 2, and the reservoir 4 is secured over the end of the container 2 to close it. At least one nozzle 10 is opened, the number of open nozzles 10 governing the width of the strip of fluid which is applied. The section of hair to be treated is then separated from the rest of the hair, the applicator is held in the position shown in FIG. 3 and the comb 16 is drawn through the hair section from above as the container 2 is squeezed gently to expel fluid through the nozzles 10. The comb 16 both stabilises the section of hair, allowing the even application of fluid along the section, and also helps the fluid to spread evenly across the section being treated.

As the treatment continues the user can easily monitor the amount of fluid remaining in the container by referring to a graduated scale 22 upon the side. There may be two graduated scales, one on each side of the container, one for the applicator in an upright position, and the other for the applicator in an inverted position.

When the treatment is finished, the reservoir 4 may be separated from the container 2 so that it can be cleaned ready for a subsequent treatment or to allow the container to be refilled.

The reservoir 4 and/or the container 2 may, however, be intended to be disposed of after one use only. It may, for example, be desirable to supply standard pre-mixed treatments in a number of containers 2 which may be fitted to a reservoir 4 just before the treatment is applied. Many treatments must, however be mixed freshly shortly before application, in which case a user would fill the container 2 when the treatment had been prepared.

As will be appreciated, the applicator according to the invention improves the ability of the user to apply a hair treatment in a controlled manner, to the extent for example that coloring only a discrete section of hair is made easier than with applicators available hitherto. Using the applicators illustrated in the drawings, it is possible to apply fine lines of highlighting treatment relatively quickly and easily compared with using existing applicators.

I claim:

1. An applicator for applying a fluid to a substrate comprising:

a reservoir for containing a treatment fluid;

a plurality of nozzles spaced apart from one another and generally parallel with one another, each nozzle having a bore formed therein, the nozzles each being pivotal independently of one another and relative to the reservoir between an open position in which each nozzle communicates directly with the interior of the reservoir through the associated bore of each nozzle such that fluid can be expelled from the reservoir, and a closed position in which flow of fluid through the bore in each nozzle is prevented; and a comb extending transversely of the axes of the nozzles and in close proximity to exit ends of the nozzles.

2. The applicator according to claim 1 wherein the reservoir is detachably mounted to a container for the treatment fluid.

3. The applicator according to claim 2 wherein the container comprises a flexible material, the fluid being expelled from the reservoir by squeezing the container.

4. The applicator according to claim 1 comprising between three and ten nozzles spaced apart from one another in a direction transverse to the axes of the nozzles.

5. The applicator according to claim 1 wherein the comb is detachably mounted to the reservoir.

6. The applicator according to claim 1 wherein the comb is mounted to the reservoir such that the plane thereof makes an angle of between 30° and 60° with the axes of the nozzles in their open positions.

7. The applicator according to claim 1 comprising a plastics material.

8. The applicator according to claim 7 wherein said plastics material comprises polypropylene.

9. The applicator according to claim 7 wherein the container, reservoir and nozzles are transparent.

10. The applicator according to claim 1 further comprising a container, the container and the reservoir including markings to indicate the volume of fluid contained therein.

11. The applicator according to claim 10 wherein the markings indicate the volume of fluid with the applicator in both an upright and an inverted condition.

* * * * *